US006799725B1

(12) United States Patent
Hess et al.

(10) Patent No.: US 6,799,725 B1
(45) Date of Patent: Oct. 5, 2004

(54) MICRO BARCODED PILL AND IDENTIFICATION/MEDICAL INFORMATION RETRIEVAL SYSTEM

(76) Inventors: Robert J. Hess, 18 Troon Ct., Lincroft, NJ (US) 07738; Scott L. Sullivan, 3 Garden Ridge, Chappaqua, NY (US) 10514

( * ) Notice: Subject to any disclaimer, the term of this patent is extended or adjusted under 35 U.S.C. 154(b) by 1446 days.

(21) Appl. No.: 08/286,785

(22) Filed: Aug. 5, 1994

(51) Int. Cl.[7] ..... G08K 07/10
(52) U.S. Cl. ..... 235/462.01; 235/462.25
(58) Field of Search ..... 235/462, 472, 235/454, 375, 455, 470, 494, 379, 466; 209/580, 581, 587, 583, 900, 938, 949

(56) References Cited

U.S. PATENT DOCUMENTS 4,143,770 A * 3/1979 Grimmell et al. ..... 209/587 X
4,388,994 A * 6/1983 Suda et al. ..... 209/583 X
4,478,658 A * 10/1984 Wittwer ..... 156/69
4,857,713 A * 8/1989 Brown ..... 235/375 X
4,889,367 A * 12/1989 Miller ..... 235/468 X
5,001,331 A * 3/1991 Leestemaker ..... 235/375
5,063,507 A * 11/1991 Lindsey et al. ..... 235/375 X
5,118,369 A * 6/1992 Shamir ..... 235/462
5,129,974 A * 7/1992 Aurenius ..... 235/462 X
5,206,490 A * 4/1993 Petigrew et al. ..... 235/468
5,249,687 A * 10/1993 Rosenbaum et al. .... 209/900 X
5,283,699 A 2/1994 Komai et al. ..... 235/462
5,348,061 A * 9/1994 Riley et al. ..... 641/104
5,401,059 A * 3/1995 Ferrario ..... 283/67

OTHER PUBLICATIONS

"Automatic Identification: Serving The Service Industries", ID Systems, Scan—Tech 87 Preview, vol. 7 No. 8, Oct. 1987.*
"Imprinting of Solid Oral Dosage Form Drug Products for Human Use", vol. 58, No. 175, Sep. 1993.*
The New York Times, Barnaby J. Feder, "For Bar Codes, an Added Dimension—The Bar Code Is Getting More Sophisticated", Wednesday, Apr. 24, 1991, First Business Page and p. D9 (2 sheets).
New Barcode World of Tomorrow presented by NEOREX.

* cited by examiner

*Primary Examiner*—Thien M. Le

(57) ABSTRACT

A pill imprinted with a micro barcode of encoded information pertaining to source identification and/or medical information pertaining to the contents of the pill. A device for reading the micro barcode on the pills and indicating what was read. The device may convey the pills in succession and sort them in accordance with the expiration date or type of medication.

24 Claims, No Drawings

MICRO BARCODED PILL AND IDENTIFICATION/MEDICAL INFORMATION RETRIEVAL SYSTEM

BACKGROUND OF THE INVENTION

The present invention relates to a pill on which is applied a micro barcode containing identification and/or medical information concerning the pill. Such identification and/or medical information is scanned and then either enunciated or displayed to a medical or health care professional handling the pill or to a patient planning to digest the pill.

Generic drugs in pill form become more common every day. The pills are in a variety of shapes and colors. Indeed, pills of one manufacturer containing one type of medication may have a confusingly similar color and shape of another containing a different medication. A mix-up between pills containing different medications is potentially dangerous for the patient relying on receiving the correct medication.

Standardizing the color and shape of every kind of pill containing the same medication may be one answer to resolving the mix-up problem, but is not commercially viable in a freely competitive marketplace, where pill manufacturers seek proprietary rights in the trade dress of their pills. Indeed, such a practice may do a disservice to the public, who may come to rely on the quality of pills from a particular manufacturer but, under standardization of shape and color, has no way of knowing whether the pill itself actually originated from that manufacturer or was substituted by a generic copy. So called tamperproof bottles help curtail unauthorized substitution of medication, but they are not completely reliable.

Even if the tamperproof bottles were to effectively prevent unauthorized pill substitution, a patient taking multiple medications, especially if the person is visually impaired or has trouble thinking clearly, may mix up the different medications and thereby take one type of medication at the wrong time. For instance, an elderly patient taking heart medicine may be trying to follow a prescribed treatment by taking various doses of medication throughout the day. Mixing one type of medication for another could prove fatal (e.g., a prescription could be: take exactly five tablets of pill X every 3 hours and take exactly two tablets of pill Y every 5 hours. Mistaking X for Y and vice versa could be disastrous).

Another problem is potency. Medication may lose its potency over time or when exposed to the elements such as sunlight. A patient may not be aware that the potency of a pill being taken is no longer viable, due to a long-shelf life in the store or in the home.

Pharmacists and other health care personnel responsible for providing the patient with medication will continue to find it increasingly difficult to distinguish one type of pill from another as pills of different sources appear similar in shape and color. Other than relying on what is printed on the bottle containing the pills, there is no way to verify that a pill's potency expiration date has not already expired, absent independent testing. With medication passing through many different distributors before reaching the patient, the unscrupulous practice of fraudulent switching of new medication for old may become increasingly the norm. Such switching may become particularly hazardous, not only because pills with diminished potency are unknowingly being taken by patients, but also if the unscrupulous merchant doing the switching mixes up one type of medication for another because of their similar shape and color.

In addition, health care professionals, such as nurses in hospitals, may be responsible each day for distributing medication to patients under their care. For convenience, they may sort the medication for the entire day as one of their first tasks in the morning. This task may be assigned to one or a few nurses on the floor to free the other nurses for other duties. If a mistake is made in sorting the medication, the mistake may not be noticed unless the nurse distributing the medication realizes upon close scrutiny that the medication is wrong. The potential for human error, therefore, is ever present.

It would therefore be desirable to provide a system to identify each individual pill before it is taken by a user as to its source, the type of medication it contains and the potency expiration date and thereby safeguard against unauthorized switching of medication or the taking of medication whose potency has lapsed.

Standard barcode typically found on packaging is too large to be imprinted on pills. It is therefore not feasible to use this technology in connection with labeling individual pills.

SUMMARY OF THE INVENTION

One aspect of the invention relates to a pill on which is applied a non-toxic, pharmaceutically inert (to the contents of the pill) label in micro barcode form. The micro barcode is coded with a pattern that, when read, is interpreted as identification and/or medical information pertaining to the pill. The identification may include information concerning the type of medication contained in the pill, the manufacturer or source identification such as the distributor and country of origin, and production lot number. The medical information may include information concerning frequency and quantity of dosages for different kinds of treatments, medically related warnings concerning the medication, and the potency expiration date.

Another aspect of the invention relates to a scanner of micro barcode that preferably is equipped with a computer program that indicates the information contained in the micro barcode to the patient or other viewer of the information. Preferably, the computer program has an internal clock and is programmed to keep track of when medications should be taken and the proper dosages.

DESCRIPTION OF THE PREFERRED EMBODIMENT

A micro barcode is about one-tenth the size of a standard barcode. The micro barcode was developed by Neorex, which is a Nagoya, Japan-based company. The scanner for reading the micro barcode has a specially developed lens that reads the micro barcode even if the lines are blurred.

Since the pill is digested, the micro barcode applied to a pill should be made from a non-toxic material (at least for the sake of good public relations), even though only trace amounts would be swallowed. Further, the micro barcode material should be pharmaceutically inert with respect to the active ingredients of the pill itself to avoid interfering with the administration of the proper dosage of medication. Some pills commercially available are imprinted with the tradename; the same type of printing dye may be used to form the micro barcode.

After imprinting the micro barcode on the pill, the pill may be coated with a transparent film to protect the micro barcode from smudging during handling. However, such coating may be dispensed with because the handling, if any, will be minimal and because the barcode reader can tolerate some blurriness in the micro barcode and still take an accurate reading.

A patient seeking to identify a pill before swallowing it, would simply place it in the scanner and allow the scanner to read the micro barcode; the scanner is connected to a system that indicates to the user in an understandable manner the information encoded in the micro barcode. This may be done by enunciating or displaying the identification information. Medical information, such as that pertaining to proper dosage amount and frequency of taking the medication, may be accessed in a like manner from data bases and then enunciated or displayed as well. The technique for enunciating or displaying the information may be done in the same manner as is done conventionally with respect to standard barcode reading.

To make an analysis, the micro barcode as read is compared with codes stored in memory to find a match. Information corresponding to the matched code may then be retrieved for display, enunciation or some other form of processing. To minimize the amount of memory required, the invention may access other data bases already containing the same information and employ the same codes. For instance, the pharmacist may already have a data base containing inventory information of medications, each being assigned a corresponding inventory code number. It then becomes a simple matter for the micro barcode to be matched up with the inventory code number to retrieve the associated information. Alternatively, a central data base may be created and accessed over phone lines that contains all the necessary information to be retrieved based on the micro barcode.

Preferably, the patient's scanner has a programmable computer with memory and is programmed with the recommended treatment schedule for medication; the program thus has an internal clock. The scanner may signal or indicate (such as by sounding an alarm) at the time when a dosage of medication should be taken. Further, it may keep track of when the medication is presumably taken, i.e., at about the time the patient places the pill within the scanner for analysis prior to digesting it. The analysis may be printed out in a conventional manner. The time during which the analysis is made also represents the approximate time the pill, if it passes the analysis as acceptable, will be swallowed.

In addition, a conveyor may be provided to convey in succession the pills individually to the scanner. The pills are then conveyed away from the scanner after analysis and sorted in dependence upon what was read by the scanner. For instance, the pills may be sorted by expiration date or by type of medication.

No system is failsafe. Even with the system of the present invention in place, an unscrupulous merchant could go through the trouble of removing the micro barcode and replacing it with a new one. However, it seems that the added layer of security afforded by imprinting a micro barcode on the medication renders its removal and replacement highly unlikely to be cost-effective. Removing the micro barcode is not a simple matter; washing or etching the barcode off may destroy the integrity of the outer coating of the medication as well. Further, criminal laws could be passed making the mere possession of a micro barcode imprinting device a crime by those involved in the medication distribution network, not unlike the criminal laws against possessing counterfeit currency equipment.

Nevertheless, if such tampering becomes widespread, the medication manufacturer could incorporate into the micro barcode a validity code that is difficult to reproduce. The validity code must be detected by the scanner before it will indicate to the patient that taking the medication is safe. For instance, the validity code may become visible to the scanner for reading only when exposed to ultraviolet light.

By referring to pills in the present application, it is intended to encompass tablets, capsules and any other orally administered form of medication in solid form.

What is claimed is:

1. A pill on which is imprinted micro barcode, said micro barcode containing information pertaining to any one of medication contents of the pill and source identification of the pill.

2. A pill as in claim 1, wherein said source identification includes information selected from the group consisting of a manufacturer, a distributor, country of origin, and production lot number.

3. A pill as in claim 1, wherein said medical information is selected from the group consisting of potency expiration date, frequency of taking medication and dosage of medication in accordance with recommended treatment, side effects, conditions that adversely affect the potency and effectiveness of the medication, and instructions on treatment in the event of adverse reaction to the medication as may result from an unauthorized taking of the medication such as by an unsupervised child.

4. A pill as in claim 1, wherein the pill is imprinted with a validity code that is not apparent as such to the eye under normal lighting conditions.

5. A device for retrieving information encoded on a micro barcode imprinted on a pill and indicating the retrieved information to a user, comprising:

means for scanning the micro barcode on the pill to retrieve information encoded in the micro barcode;

means for interpreting the scanned micro barcode; and means responsive to results of interpretation by said interpreting means for indicating information encoded in the micro barcode in a manner understandable to the user.

6. A device as in claim 5, wherein said responsive means includes means for conveying to said scanning means in succession a plurality of pills each imprinted with a respective micro barcode and means for conveying away the pills from said scanning means.

7. A device as in claim 6, wherein said means for conveying away the pills includes means for sorting the pills in dependence upon results from said interpreting means.

8. A device as in claim 7, wherein said results include a determination of an elapsement of a potency expiration date encoded in the micro barcode.

9. A device as in claim 8, wherein said results include a determination of which pills contain medication that is of the same type.

10. A device as in claim 5, further comprising means for searching for a validity code on the pill, the validity code being distinct from the information retrieved from the micro barcode that becomes indicated to the user, said responsive means being programmed to fail to reveal the validity code itself to the user.

11. A method of retrieving information encoded on a micro barcode imprinted on a pill and indicating the retrieved information to a user, comprising the steps of:

scanning the micro barcode on the pill to retrieve information encoded in the micro barcode;

interpreting the scanned micro barcode; and in response to results of the interpreting, indicating information encoded in the micro barcode in a manner understandable to a user.

12. A method as in claim 11, wherein the step of indicating includes conveying in succession a plurality of pills each imprinted with a respective micro barcode before the step of scanning and conveying away the pills after the step of scanning.

13. A method as in claim 12, wherein the step of conveying away the pills includes sorting the pills in dependence upon results from the step of interpreting.

14. A method as in claim 13, wherein said results include determining an elapsement of a potency expiration date encoded in the micro barcode.

15. A method as in claim 13, wherein said results include determining which pills contain medication that are of the same type.

16. A device as in claim 11, further comprising the step of searching for a validity code on the pill, the validity code being distinct from the information retrieved from the micro barcode that becomes indicated to the user, and revealing a presence of a validity code, if present, but failing to reveal the validity code itself to the user during the step of indicating information.

17. A device for retrieving information encoded on a micro barcode imprinted on a pill and indicating the retrieved information to a user, comprising:

a scanner configured and arranged to scan the micro barcode on the pill and retrieve information encoded in the micro barcode;

an interpreter of the scanned micro barcode; and an indicator of the information encoded in the micro barcode in a manner understandable to the user in response to results of interpretation by the interpreter.

18. A device as in claim 17, further comprising a conveyor configured and arranged to convey to the scanner in succession a plurality of pills each imprinted with a respective micro barcode and a further conveyor configured and arranged to convey the pills away from the scanner.

19. A device as in claim 18, wherein the further conveyor includes a sorter configured and arranged to sort the pills in dependence upon the results of the interpretation by the interpreter.

20. A device as in claim 17, wherein the interpreter includes a determiner of an elapsement of a potency of expiration date encoded in the micro barcode.

21. A device as in claim 17, wherein the interpreter includes a determiner of which pills contain medication that is of the same type.

22. A device as in claim 17, further comprising a searcher of a validity code on the pill, the validity code being distinct from the information retrieved from the micro barcode that becomes indicated to the user.

23. A device as in claim 22, further comprising a controller programmed to fail to reveal the validity code itself to the user.

24. A method of retrieving information encoded by a micro bar code, comprising scanning a micro bar code that pertains to medication contents of a pill; comparing the scanned micro bar code with codes stored in memory to find a match;

retrieving information corresponding to the matched code, the retrieving including accessing a central data base over phone lines to retrieve the information; and making an indication of the retrieved information, the retrieved information being selected from a group consisting of information concerning frequency and quantity of dosages of the medication contents, information on medically related warnings concerning the medication contents, and information pertaining to a potency expiration date for the medication contents.

* * * * *